US006722300B2

(12) United States Patent
Trobaugh, III et al.

(10) Patent No.: US 6,722,300 B2
(45) Date of Patent: Apr. 20, 2004

(54) COMFORTER CLOSER APPARATUS

(75) Inventors: Robert A. Trobaugh, III, Norcross, GA (US); Parks C. Stewart, Norcross, GA (US); Vadim Z. Shtylman, Alpharetta, GA (US); Nathan D. Turpin, Epworth, GA (US); Jeffrey J. McGinnis, Cumming, GA (US)

(73) Assignee: Phoenix Automation, Inc., Norcross, GA (US)

( * ) Notice: Subject to any disclaimer, the term of this patent is extended or adjusted under 35 U.S.C. 154(b) by 28 days.

(21) Appl. No.: 10/074,108

(22) Filed: Feb. 12, 2002

(65) Prior Publication Data

US 2002/0108549 A1 Aug. 15, 2002

Related U.S. Application Data

(60) Provisional application No. 60/269,037, filed on Feb. 13, 2001.

(51) Int. Cl.[7] ..... D05B 11/00
(52) U.S. Cl. ..... 112/470.12
(58) Field of Search ..... 112/470.05, 470.12, 112/122.3, 153, 311, 475.08, 147, 141, 10, 11

(56) References Cited

U.S. PATENT DOCUMENTS

| | | | | | |
|---|---|---|---|---|---|
| 2,281,308 | A | | 4/1942 | Johnson | 112/117 |
| 3,527,180 | A | * | 9/1970 | Cerioni | |
| 3,747,543 | A | * | 7/1973 | Fischbein et al. | |
| 4,155,317 | A | * | 5/1979 | Enomoto | |
| 4,408,552 | A | | 10/1983 | Kondo et al. | 112/119 |
| 4,716,845 | A | | 1/1988 | Codos | 112/118 |
| 5,018,416 | A | | 5/1991 | Freermann | 83/14 |
| 5,027,726 | A | | 7/1991 | Brower et al. | 112/117 |
| 5,040,473 | A | | 8/1991 | Zesch et al. | 112/117 |
| 5,088,425 | A | * | 2/1992 | Adams | |
| 5,379,708 | A | * | 1/1995 | Moll et al. | |
| 5,619,942 | A | | 4/1997 | Stewart et al. | 112/470.07 |
| 5,669,320 | A | | 9/1997 | Stewart et al. | 112/470.07 |
| 5,685,248 | A | | 11/1997 | Stewart et al. | 112/470.07 |
| 5,806,449 | A | * | 9/1998 | Schramayr et al. | |
| 5,913,277 | A | | 6/1999 | Resta | 112/470.12 |
| 5,928,462 | A | | 7/1999 | Stewart et al. | 156/359 |
| 6,058,863 | A | | 5/2000 | Stewart et al. | 112/470.36 |
| 6,136,120 | A | | 10/2000 | Stewart et al. | 156/88 |

* cited by examiner

*Primary Examiner*—Ismael Izaguirre
(74) *Attorney, Agent, or Firm*—Sutherland Asbill & Brennan LLP

(57) ABSTRACT

An apparatus for closing an open side of a fabric article from a first end to a second end. The apparatus may include a gripping device for gripping the first end and the second end of the open side of the fabric article and then tensioning the open side. The apparatus also may include a closing device positioned adjacent to the gripping device such that the closing device maneuvers along the fabric article to fasten the open side from the first end to the second end.

36 Claims, 8 Drawing Sheets

COMFORTER CLOSER APPARATUS

RELATED APPLICATIONS

The present application is a non-provisional application based upon Provisional Application Ser. No. 60/269,037, filed on Feb. 13, 2001.

TECHNICAL FIELD

The present invention relates to automated textile manufacturing equipment and more particularly relates to an automated apparatus for closing and/or hemming a comforter or a similar type of textile product in a high speed and high quality manner.

BACKGROUND OF THE INVENTION

A bedding accessory known as a comforter generally includes an amount of batting placed within a fabric enclosure. A comforter generally has been manufactured, at least in part, in a manual process. By way of example in FIG. 1, a comforter 10 may be manufactured by sewing a comforter bag 11 inside out on three sides 12, 13, 14; the comforter bag 11 may then be turned right side out; an amount of batting 20 may be inserted therein; and a remaining side 15 may be hemmed in a manual process.

Most quality comforters, however, generally require what is known as a "French hem" or other types of specialty hems. To manufacture such a French hem, both layers of the comforter are folded in and then the hem is sewn. An example of a French hem is shown in FIG. 2. As is shown, an edge 30 of a top layer of fabric 40 is folded downward while an edge 50 of a bottom layer of fabric 60 is folded upwards. The two edges 30, 50 are aligned and a hem 70 is applied from a first end 80 to a second end 90 of the open side 15. In the manual hemming process, however, it is often difficult to maintain both layers 40, 60 with an even fold along the length of the open side 15.

A further issue is the fact that a quality comforter 10 generally requires that the batting 20 extend all the way to the hem 70. A comforter 10 with an empty space adjacent to the hem 70 generally may not be acceptable to consumers. The placement of the batting 20 along the edges 30, 50, however, often complicates the hemming process. Such a manufacturing process thus may be time intensive.

What is desired, therefore, is a method and apparatus to speed the comforter closing process. The comforter should be closed and hemmed in a high speed and high quality manner.

SUMMARY OF THE INVENTION

The present invention thus provides an apparatus for closing an open side of a fabric article from a first end to a second end. The apparatus may include a gripping device for gripping the first end and the second end of the open side of the fabric article and then tensioning the open side. The apparatus also may include a closing device positioned adjacent to the gripping device such that the closing device maneuvers along the fabric article to fasten the open side from the first end to the second end.

Specific embodiments of the present invention may include the use of one or more guide rails associated with the closing device such that the closing device may maneuver along the guide rails. The apparatus also may include a drive system associated with the closing device. The drive system may include one or more drive belts so as to maneuver the closing device along the guide rails. The closing device may include a closing device frame. The frame may be positioned on the guide rails for movement thereon. An amount of batting may extend out of the open side of the fabric article. The closing device may include a pusher device so as to push the amount of the batting within the open side of the fabric article. The pusher device may include a reciprocating plunger. If the fabric article includes a first layer with a folded edge and a second layer with a folded edge, the pusher device may include a pair of edge guides for maintaining the folded edge of the first layer and the folded edge of the second layer in alignment. The apparatus also may include a cutting device positioned adjacent to the gripping device so as to cut any excess batting from the first end to the second end of the open side.

If the fabric article includes a first layer with a folded edge and a second layer with a folded edge, the closing device may include a tensioning device. The tension device may include a harpoon with a number of extensions. The tensioning device may include a tensioning drive so as to insert the harpoon between the first layer and the second layer, rotate the harpoon such that the extensions engage the folded edge of the first layer and the folded edge of the second layer, and then retract the harpoon by about a predetermined distance so as to tension the folded edge of the first layer and the folded edge of the second layer.

The closing device may include an edge guide. The edge guide may include a number of U-shaped compartments. The closing device also may include a fastening device. The fastening device may include a sewing head. The apparatus also may include a proximity device associated with the closing device so as to determine the position of the closing device along the gripping device.

The gripping apparatus may include a first edge gripper positioned to accommodate the first end of the fabric article and a second edge gripper positioned to accommodate the second end of the fabric article. The gripping apparatus may include a gripper drive so as to maneuver the first edge gripper and/or the second edge gripper with respect to each other. The first edge gripper and the second edge gripper may include a pin assembly. The pin assembly may include an insertion pin for entry into the first end and the second end of the open side of the fabric article. The pin assembly may include a rotating arm driven by a pin drive. The first edge gripper and the second edge gripper also may include a clamping mechanism for clamping the first end and the second end of the fabric article. The clamping mechanism may include a number of jaws. The clamping mechanism may include a clamping drive such that one or more of the jaws may rotate.

The apparatus also may have a number of the gripping devices, including a first pair and a second pair. The apparatus may include an edge gripper track to as to maneuver the gripping devices between a loading station and a fastening station. The apparatus also may have a removal mechanism positioned about the fastening station.

A further embodiment of the present invention may provide for an apparatus for closing a fabric article. The fabric article may have a first layer with a folded edge and a second layer with a folded edge. The apparatus may include a tensioning device positioned along a predetermined path. The tension device may include a harpoon. The harpoon may include a number of prongs. The tensioning device may include a tensioning drive such that the tensioning drive inserts the harpoon between the first layer and the second layer, rotates the harpoon such that the prongs engage the folded edge of the first layer and the folded edge of the second layer, and then retracts the harpoon by about a predetermined distance so as to tension the folded edge of the first layer and the folded edge of the second layer. The apparatus also may include a fastening device positioned along the predetermined path. The fastening device fastens the folded edge of the first layer with the folded edge of the second layer.

The apparatus also may include an edge guide positioned along the predetermined path between the tensioning device and the fastening device. The edge guide may include a number of U-shaped compartments. The fastening device may include a sewing head so as to stitch the folded edge of the first layer with the folded edge of the second layer.

The method of the present invention may provide for closing an open side of a fabric article. The fabric article may have a first layer and a second layer. The method may include the steps of folding the first layer to form a first folded edge, folding the second layer to form a second folded edge, aligning the first folded edge and the second folded edge, passing a tensioning guide along the open side to keep the first folded edge and the second folded edge in alignment, and passing a fastening device along the open side to close the open side along the first folded edge and the second folded edge. The fabric article may include an amount of batting therein. The method further may include the step of adding additional batting prior to the step of passing the fastening device along the open side and the step of shaking the fabric article to position the batting therein.

Other features of the present invention will become apparent upon review of the following specification when taken in conjunction with the drawings and the appended claims.

BRIEF DESCRIPTION OF THE DRAWINGS

FIG. 3 is a perspective view of a comforter closer apparatus of the present invention.

DETAILED DESCRIPTION OF THE PREFERRED EMBODIMENTS OF THE INVENTION

Figure 4:
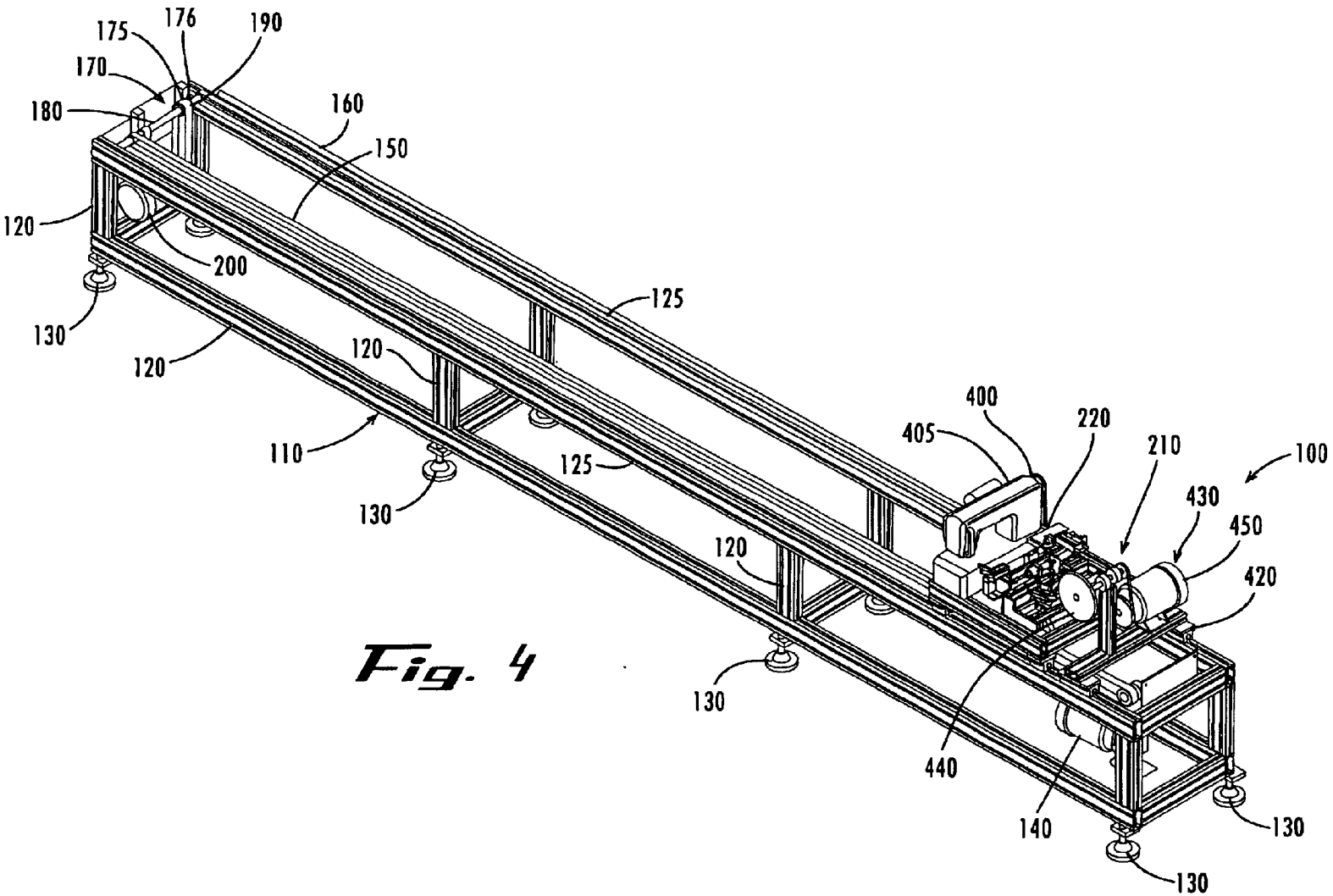
FIG. 4 is a further perspective view of the comforter closer apparatus of FIG. 3.

Referring now to the drawings, in which like numerals refer to like parts throughout the several views, FIGS. 3 and 4 show a comforter closing apparatus 100 of the present invention. Although the term "comforter" 10 is used herein, it is understood that the closer 100 can hem any type of textile product. For example, the closer 100 also may be used with sleeping bags, pillows, bedspreads, duvets, or similar types of products.

The various stations of the comforter closer apparatus 100 may be set, monitored, and controlled by a Programmable Logic Controller ("PLC") 105 such as the 90-30 PLC sold by the General Electric Company of Fairfield, Conn. Alternatively, a personal computer, such as a conventional IBM-compatible computer with the Pentium® microprocessor sold by Intel Corporation of Santa Clara, Calif. or its equivalent may be used, or other types of conventional control devices.

The comforter closer apparatus 100 may include an assembly frame 110. The frame 110 may include any number of brackets 120 or other types of rigid members. The frame 110 may have any desired size or dimension. The frame 110 may be made out of steel or other types of substantially rigid materials. The frame 110 may include a number of guide rails 125. Two of the guide rails 125 may be positioned on the brackets 120 in a substantially parallel arrangement. The guide rails 125 may be made out of steel or other types of substantially rigid materials. The frame 110 may be supported by a number of footings 130.

Positioned on the frame 110 may be a drive device 140. The drive device 140 may be a belt driven system with a first drive belt 150 and a second drive belt 160. The drive belts 150, 160 may be positioned about and largely follow the guide rails 125. The drive belts 150, 160 may be mounted on a number of pulley wheels 170 for movement thereon. One set of the pulley wheels 175 may be connected by a drive shaft 180. Another one of the pulley wheels 176 also may be positioned on the drive shaft 180 and driven by a third drive belt 190. The third drive belt 190 may be driven by a pulley motor 200. The pulley motor 200 may be a conventional AC, DC, or servo-type motor with about one-half (0.5) to about two (2) horsepower. The pulley motor 200 thus may drive the drive belts 150, 160 via the third drive belt 190, the drive shaft 180, and the pulley wheel 175. The driven belts 150, 160, 190 may be cogged timing belting, chain, steel lined belting, or similar types of drive means. Although three drive belts 150, 160, 190 have been described herein, any number or configuration of the drive belts may be used herein.

Positioned on top of the frame 110 for movement by the drive device 140 may be a hemming device 210. The hemming device 210 may include a hemming frame 220. The hemming frame 220 may be made out of steel, extruded aluminum, or similar types of substantially rigid materials. The hemming frame 220 may have a number of rail guides 230 positioned thereon. The rail guides 230 may be sized to accommodate the guide rails 125. The frame 220 also may have a number of drive belt guides 240 positioned thereon. The drive belt guides 240 may accommodate the drive belts 150, 160 such that the hemming frame 220 may maneuver laterally along the guide rails 125 of the frame 110 as pulled by the drive belts 150, 160 of the drive system 140.

Figure 5:
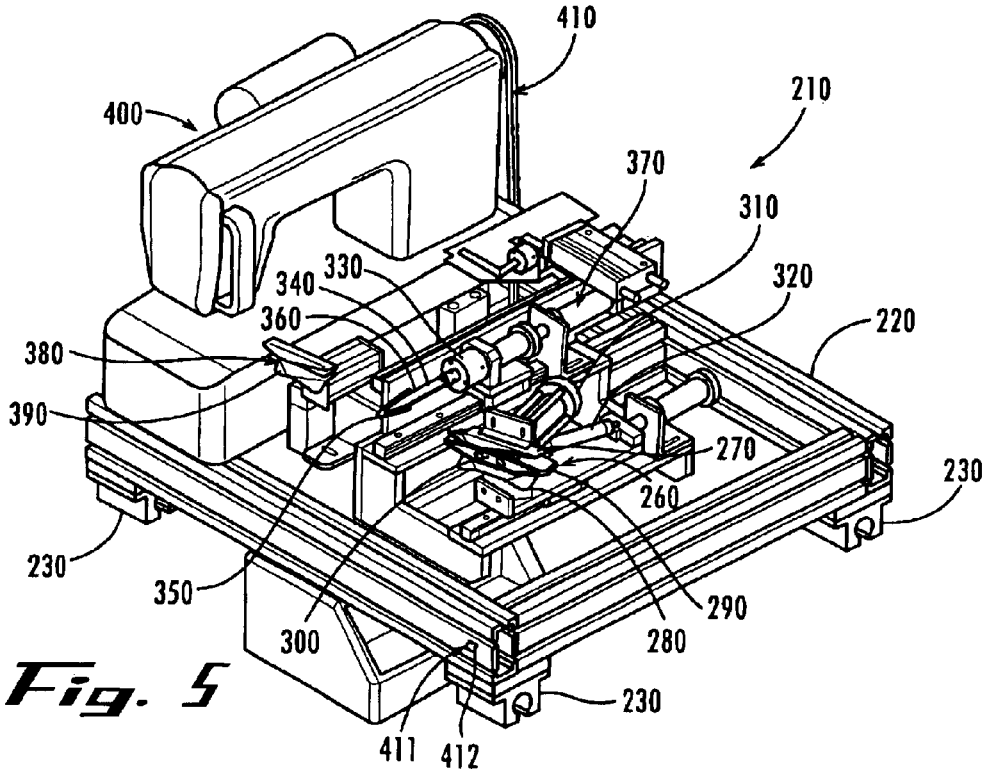
FIG. 5 is a perspective view of the hemming device of the comforter closer apparatus of FIG. 3.
Figure 6:
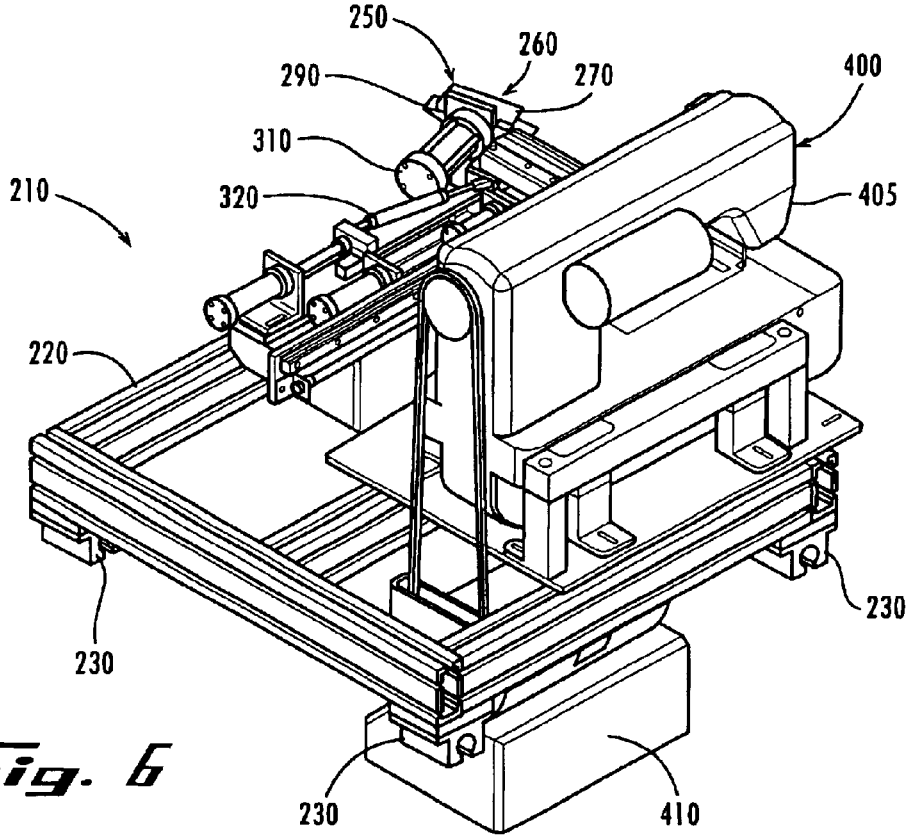
FIG. 6 is a further perspective view of the hemming device of the comforter closer apparatus of FIG. 5.
Figure 7:
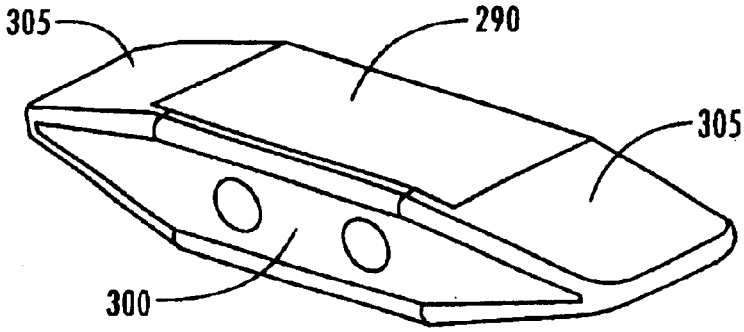

As is shown in FIGS. 5 and 6, the hemming device 210 may include a pusher device 250. The pusher device 250 may be mounted onto the hemming frame 220. The pusher device 250 may push or force any excess batting 20 that may extend beyond the edges 30, 50 of the fabric layers 40, 60 back into the comforter 10 before the hem 70 is sewn. The pusher device 250 may include a pusher head 260. The pusher head 260 may include an upper edge guide 270 and a lower edge guide 280. The edge guides 270, 280 may be substantially U-shaped so as to maintain the edges 30, 50 of the fabric layers 40, 60 in a proper fold. The edge guides 270, 280 may be made out of a metal or other types of substantially rigid materials.

Figure 1:
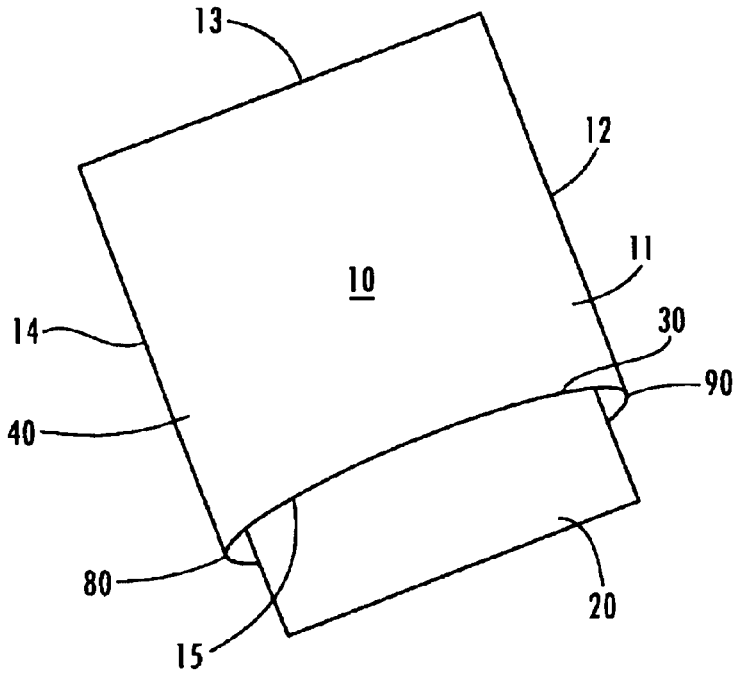
FIG. 1 is a perspective view of a comforter with an open side and an amount of excess batting.
Figure 2:
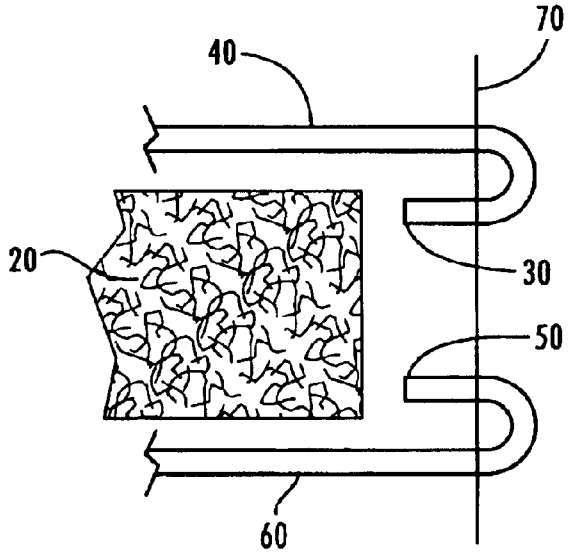
FIG. 2 is a side cross-sectional view of a comforter with a French hem.
Figure 7:
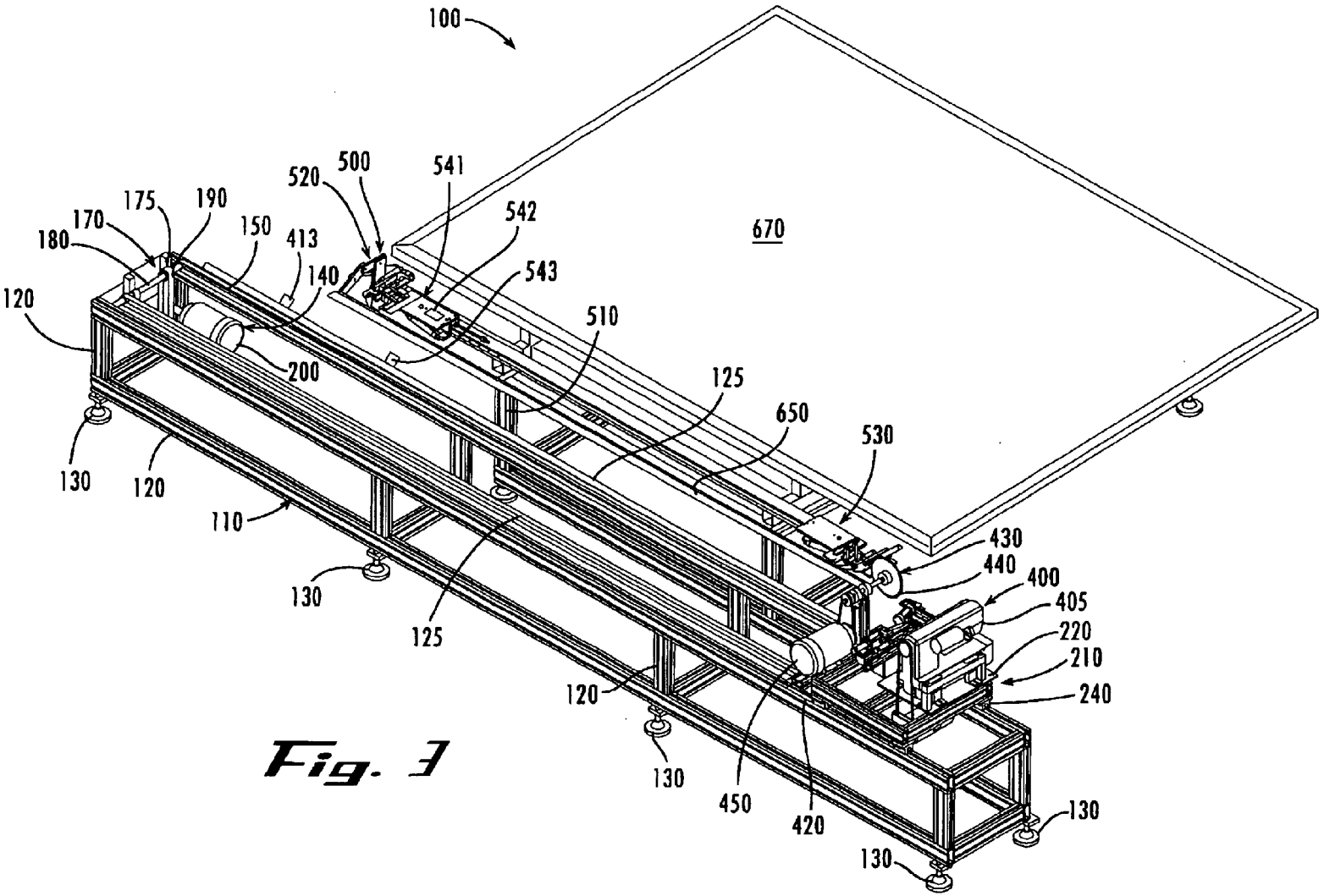
FIG. 7 is a perspective view of a plunger of the hemming device of FIG. 5.

A plunger 290 may be positioned between the edge guides 270, 280. The plunger 290 may have any convenient size or shape. As is shown in FIG. 7, the plunger 290 preferably has a blunt face 300 and a tapered body 305 so as to fit between the edge guides 270, 280. The plunger 290 may travel in a reciprocating manner towards and away from the fabric layers 40, 60. The plunger 290 may be maneuvered by a plunger drive 310. The plunger drive 310 may include a conventional piston driven by an air cylinder. The plunger drive 310 may operate at about thirty (30) to about eighty (80) pounds per square inch. Alternatively, the plunger drive 310 may include a conventional solenoid, a linear servo, oscillating mechanisms, belts, various types of screw drive means, and other types of drive means. As is described below, the pusher device 250 may operate as a separate unit independent of the hemming device 210.

Alternatively to the use of the plunger 290, the pusher device 250 also may include a forced air device. The forced air device may blow the batting 20 within the fabric layers 40, 60. The pusher device 250 also may include any other type of means so as to force the batting 20 into place. For example, multistage pushing devices, devices for stretching and releasing of the comforter 10, rotating brushes, high pressure and high velocity air devices, rollers, and belts also may be used. The pusher device 250 may not be required if the batting 20 is already properly positioned within the fabric layers 40, 60.

The pusher device 250 also may include a pusher drive 320. The pusher drive 320 may be positioned on the hemming frame 220. The pusher drive 320 also may include a conventional piston driven by an air cylinder, a linear servo, belt driven mechanisms, an electronic solenoid, or similar types of drive means. The pusher drive 320 may operate with about thirty (30) to about eighty (80) pounds per square inch. The pusher drive 320 may maneuver the pusher head 260 about the hemming frame 220 as desired. Operation of the plunger 290, the pusher drive 320, and the pusher device 250 as a whole may be controlled by the controller 105.

Figure 8:
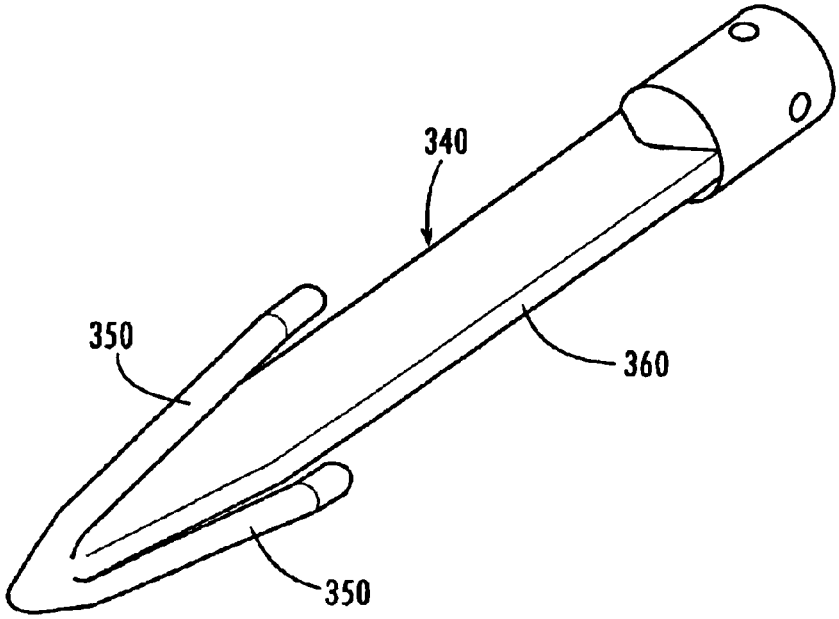
FIG. 8 is a perspective view of a harpoon of the hemming device of FIG. 5.

The hemming device 210 may include a tensioning device 330. The tension device 330 may be positioned on the frame 220 adjacent to or near by the pusher device 250. The tensioning device 330 may include a harpoon 340. As is shown in FIG. 8, the harpoon 340 may have a number of prongs 350 that are spaced apart from a central shaft 360. The harpoon 340 may be made out of stainless steel, cast metal, plastics, ceramics, or similar types of substantially rigid materials. The harpoon 340 may be powered for reciprocating and rotational motion by a tensioning drive 370. The tensioning drive 370 may include a conventional piston driven by an air cylinder. Alternatively, solenoids, servos, stepper motors, screws, belt drives, or similar types of drive means may be used. The tensioning drive 370 may operate with about twenty (20 to about eighty (80) pounds per square inch. Rotational movement for the harpoon 340 may be provided by a pneumatic or electrical rotary actuator, an AC, DC, or servo motor, a stepper motor, or similar types of drive means.

The harpoon 340 may rotate such that its prongs 350 are largely horizontal and then be advanced by the tensioning drive 370 between the layers of the fabric 40, 60. Once the prongs 350 clear the edges 30, 50, the harpoon 340 may be rotated by about ninety degrees (90°) or so and retract slightly such that the prongs 350 are positioned within the folds along the edges 30, 50 of the fabric layers 40, 60. The tensioning device 330 thus keeps the folds along the edges 30, 50 of the fabric layers 40, 60 slightly tensioned and in proper alignment. In other words, the tensioning device 330 slightly "pulls" on the fabric layers 40, 60.

The harpoon 340 also may be removed in the same manner. Specifically, the tensioning drive 370 may advance the harpoon 340 such that the prongs 350 clear the edges 30, 50 of the layers of the fabric 40, 60. The harpoon 340 again may rotate by about ninety degrees (90°) or so to the substantially horizontal position. The tensioning drive 370 then may withdraw the harpoon 340. Operation of the tensioning device 330 may be controlled by the control 105.

Figure 9:
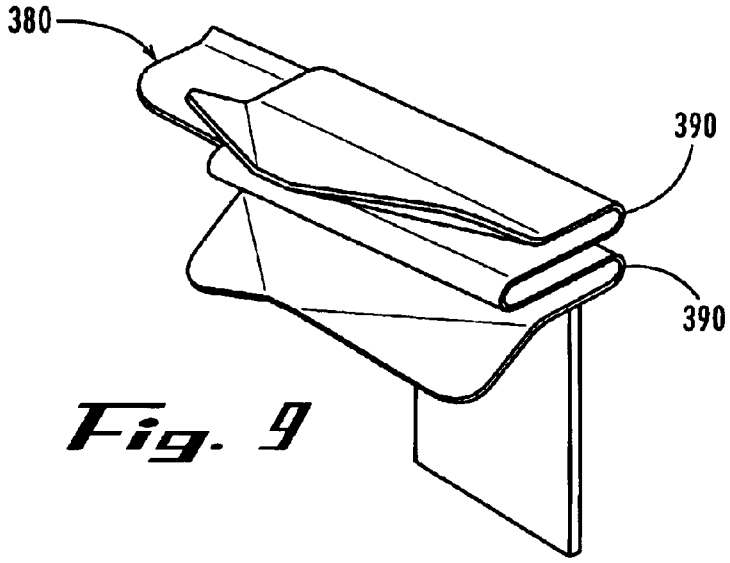
FIG. 9 is a perspective view of an edge guide of the hemming device of FIG. 5.

The hemming device 210 may include an edge guide 380. The edge guide 380 may be positioned on the hemming frame 220 adjacent to or near by the tensioning device 330. As is shown in FIG. 9, the edge guide 380 may have two (2) U-shaped compartments 390 so as to maintain the folds in the edges 30, 50 of the fabric layers 40, 60 in place. The edge guide 380 may be positioned relative to the tensioning device 330 such that the edge guide 380 "pushes" on the edges 30, 50 of the fabric layers 40, 60 while the tensioning device 330 pulls the edges 30, 50 so as to keep the edges 30, 50 properly aligned and in tension. The edge guide 380 may be made out of stainless steel, plastics, cast metals, ceramics, or similar types of substantially rigid materials.

The hemming device 210 may include a fastening device 400. The fastening device 400 may be positioned on the hemming frame 220 adjacent to or near by the edge guide 380. The fastening device 400 may be a sewing head 405 so as to sew the hem 70 into the fabric layers 40, 60. For example, a Pfaff brand or a Juki brand sewing head or similar type of sewing head may be employed. Further, more than one type of sewing head 405 or fastening device 400 may be employed so as to provide versatility in accommodating various types of materials or speeds. For example, the sewing head 405 may be a lock stitch head with a bobbin or a chain stitch head with no bobbin. The lock stitch head provides a uniform stitch that may not unravel. The chain stitch head, however, may be significantly faster.

Although the fastening device 400 has been described in terms of a sewing head 405, any other type of fastening means may be used. For example, the fastening device 400 may use ultrasonics, glue, hot air bonding, pressure, and other methods known to those skilled in the art so as to fasten the fabric layers 40, 60.

The sewing head 405 or other type of fastening device 400 may be belt driven via a fastening device drive 410. The fastening device drive 410 may be a 1½ horsepower electrical motor, a servo motor, a stepper motor, or a similar type of drive means. Operation of the fastening device 400 and the fastening device drive 410 may be controlled by the controller 105.

The hemming device 210 may include a proximity device 411. The proximity device 411 may include a sensor 412 positioned on the hemming frame 220 and a proximity marker 413 positioned on the frame 110 or adjacent thereto. Alternatively, the relative positions could be reversed. The proximity device 411 may be in communication with the controller 105 so as to inform the controller 105 when the hemming frame 220 has reached the proximity marker 413. The proximity device 411 may use a mechanical system in which the proximity sensor 412 and the proximity marker 413 come into physical contact with one another. Alternatively, the proximity device 411 may use light-based devices, magnetics, or similar types of techniques.

In addition to the proximity device 411, the location of the hemming device 210 may be controlled by active position monitoring through the use of a position encoder, potentiometer, or other types of position monitoring devices. Position tracking also may be accomplished by using a stepper or servo motor and keeping track of the number of steps. This method thus may provide position control without the use of the proximity device.

Positioned next to the hemming frame 220 may be a cutting frame 420. The cutting frame 420 may be substantially identical to the hemming frame 220 in terms of materials and construction. The cutting frame 420 may have any convenient size. The cutting frame 420 may be positioned on the frame 110 and be maneuvered along the guide rails 125 by the drive system 140. The cutting frame 220 and hemming frame 420 may be fixedly attached thereto or they may be separate structures.

Figure 10:
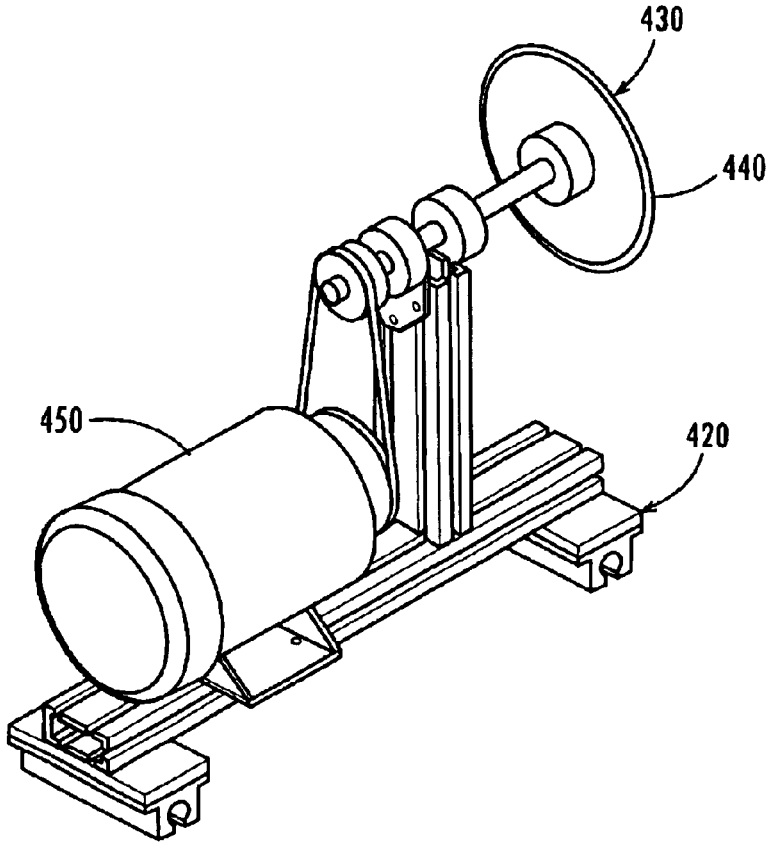
FIG. 10 is a perspective view of the cutting device of the comforter closer apparatus of FIG. 3.

As is shown in FIG. 10, positioned on the cutting frame 420 may be a cutting device 430. Alternatively, the cutting device 430 may be positioned on the hemming frame 220. Alternatively, the cutting device 430 may be positioned on another frame remote from the hemming device 210 and the assembly frame 110. The cutting device 430 may include a cutting wheel 440 driven by a cutting head motor 450. The cutting wheel 440 may be a conventional circular cutting wheel. The cutting wheel 440 may be belt driven or otherwise driven via the cutting head motor 450. The cutting head motor 450 may be a conventional electrical motor with about one-half (0.5) to about two (2) horsepower or a similar type of device. Operation of the cutting device 430 may be controlled by the controller 105. The cutting device 430 and the cutting frame 420 may be pushed along the guide rails 125 by the hemming device 210 or they may be pulled by the drive device 140. Alternatively, the cutting device 430 may maneuver by its own drive system.

Figure 11:
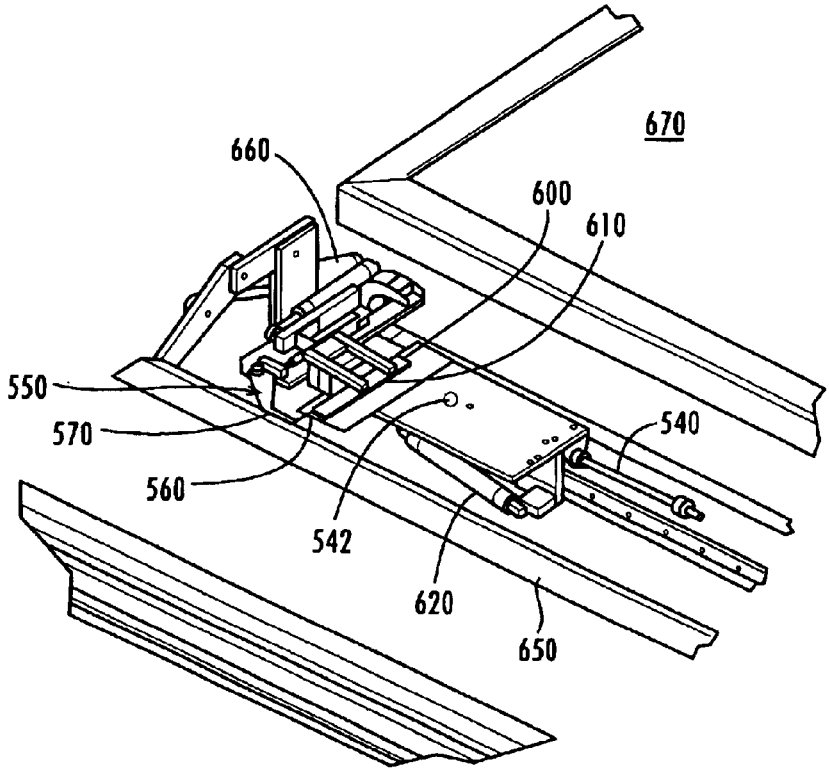
FIG. 11 is a perspective view of an edge gripper of the gripping device for the comforter closer apparatus of FIG. 3.
Figure 12:
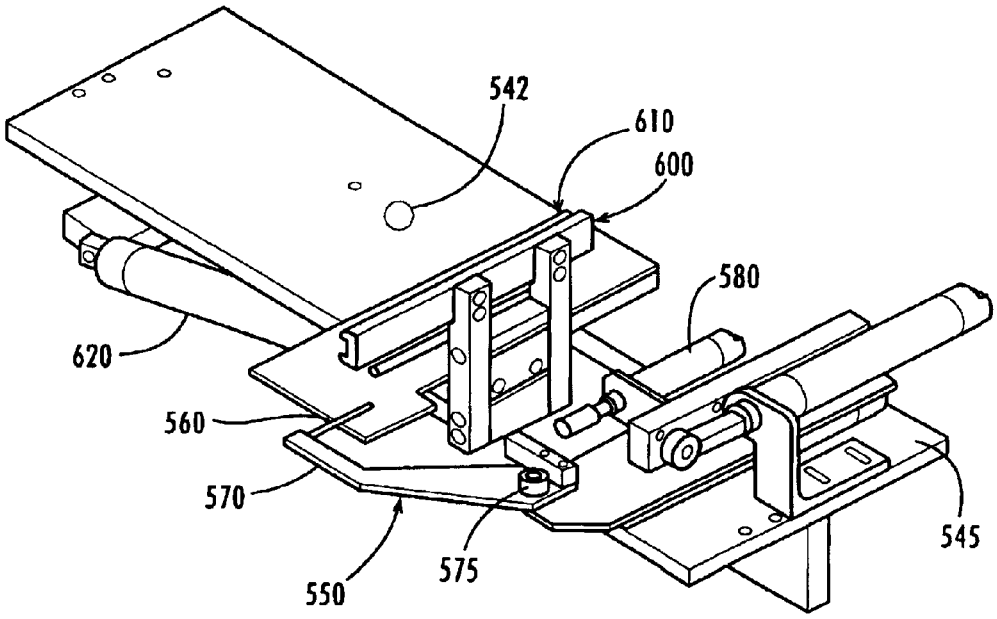
FIG. 12 is a further perspective view of an edge gripper of the gripping device for the comforter closer apparatus of FIG. 3.

As is shown in FIGS. 3, 11, and 12, positioned adjacent to the frame 110 may be a gripper assembly 500. The gripper assembly 500 may include a gripper assembly frame 510. The gripper assembly frame 510 may be similar to the frame 110 described above in terms of materials and construction. The gripper assembly frame 510 may have any convenient size or dimension. The gripper assembly frame 510 and the frame 110 may be fixedly attached to one another.

As is shown in FIGS. 11 and 12, the gripper assembly 500 may include a first edge gripper 520 and a second edge gripper 530. The edge grippers 520, 530 may be positioned on the gripper frame 510. One of the edge grippers 520, 530 may be stationary while the other may be capable of lateral movement along the gripper assembly frame 510. One or both of the gripper assemblies 520, 530 may be maneuverable via a gripper drive 540. The gripper drive 540 may be an air cylinder, an AC or DC motor, a belt drive, a servo or stepper motor, a solenoid, or a similar type of drive means. The gripper drive 540 may be mounted on the gripper frame 510. The gripper drive 540 may operate at about twenty (20) to about eighty (80) pounds per square inch.

Each edge gripper 520, 530 may include an edge gripper plate 545. Each edge gripper plate 545 may be positioned on the gripper assembly frame 510 and may be stationary or movable as described above. The edge gripper plates 545 may be made out of metal, plastic, wood, or other type of substantially rigid materials. Each edge gripper 520, 530 also may have a pin assembly 550. Each pin assembly 550 may include an insertion pin 560 positioned on a rotating arm 570. The insertion pin 560 may be an elongated shaft or a similar type of structure. The rotating arm 570 may be positioned on the gripper plate 545 via a pivot 575. The pin assembly 550 and the rotating arm 570 may be made out of metal, plastic, or other types of substantially rigid materials.

The pin assembly 550 also may include a pin drive 580 so as to push the rotating arm 570 back and forth as desired. The pin drive 580 may include a conventional piston driven by an air cylinder, a solenoid, a rotary actuator, or a similar type of drive means. The pin drive 580 may operate with about ten (10) to about thirty (30) pounds per square inch. The insertion pin 560 of the pin assembly 550 may swing forward so as to catch the edges 80, 90 of the open side 15 of the comforter 10. Alternatively, the pin assembly 550 may be manually operated or partially manually operated such that the user inserts the insertion pin 560 into the comforter 10 while the pin drive 580 removes the insertion pin 560 from the comforter 10. Operation of the pin assembly 550 may be controlled by the controller 105.

The edge grippers 520, 530 also may have a clamping mechanism 600. The clamping mechanism 600 may be positioned adjacent to the pin assembly 550 on the gripper plate 545. The clamping mechanism 600 may include a set of jaws 610. One of the jaws 610 may be stationary while the other one may rotate. Alternatively, both jaws 610 may be maneuverable. The jaws 610 may rotate via a clamping drive 620. The clamping drive 620 may be an air cylinder, a solenoid, a rotary actuator, or a similar type of device. The clamping drive 620 may operate the jaws 610 at about thirty (30) to about sixty (60) pounds per square inch. Operation of the clamping mechanism 600 may be controlled by the controller 105. Once the pin assembly 550 catches the edges 80, 90 of the open side 15 of the comforter 10, one of the edge grippers 520, 530 may then tension the open side 15 of the comforter 10 by extending laterally along the frame 510. The clamping mechanism 600 may then clamp the open end 15 in place.

The gripper assembly 500 may include a proximity device 541. The proximity device 541 may include a sensor 542 positioned on one the gripper plates 545 and a proximity marker 543 positioned on the gripper frame 510 or adjacent thereto. Alternatively, the relative positions could be reversed. The proximity device 541 may be identical to the proximity device 411 described above.

The gripper assembly 500 also may include a moveable bar 650. The bar 650 may extend the length of the gripper assembly frame 510 and may be attached thereto. The bar 650 may be made out of metal such as extruded aluminum, wood, plastics, or other types of substantially rigid materials. The bar 650 may be operated by a bar drive 660. The bar drive 660 may be a conventional air cylinder or a similar type of device. The bar drive 660 may operate at about thirty (30) to sixty (60) pounds per square inch. The bar 650 may maneuver up and down so as to support the comforter 10 as needed in cooperation of the cutting head 430. Operation of the bar drive 660 may be controlled by the controller 105.

A support table 670 or other type of support structure may be positioned adjacent to the gripper frame 510 and other wise adjacent to the assembly frame 610. The support table 670 may be used to support the comforter 10 as will be described in more detail below.

In use, the edges 30, 50 of the fabric layers 40, 60 of the open end 15 of the comforter 10 may be folded over to form a French hem. The comforter 10 may then be positioned on the support table 670 adjacent to the gripper assembly 500.

Specifically, the first end 80 of the comforter 10 may be positioned adjacent to the first edge gripper 520 while the second edge 90 may be positioned adjacent to the second edge gripper 530. The comforter closer apparatus 100 may then be activated. The controller 105 may activate the pin assemblies 550 such that the insertion pins 560 may catch the edges 80, 90 of the open end 15. Alternatively, the insertion pins 560 may be manually inserted. If the first edge gripper 520 is stationary, the second edge gripper 530 may maneuver laterally a slight distance so as to tension the open end 15. The distance moved by the second edge gripper 530 may be controlled by the proximity device 541. The distance may be determined by the controller 105 so as to provide a predetermine amount of tension. Once the open edge 15 is properly tensioned, the clamping mechanism 600 may clamp both edges 80, 90 of the comforter 10. The open end 15 is then firmly held in place within the gripper assembly 500.

The hemming device 210 and the cutting device 430 may then be operated by the controller 105. The cutting device 430 may be used if an excess amount of the batting 20 extends beyond the edges 30, 50 of the fabric layers 40, 60. The wheel 440 of the cutting device 430 may travel along the length of the frame 110 and/or the moveable bar 650 such that only a pre-determined amount of the batting 20 may be left extending over the edges 30, 50. For example, about an inch or so of the batting 20 may remain. The extra batting 20 may simply drop off of the frame 110 or a suction device may accompany the cutting device 430.

The controller 105 may then direct the drive system 140 to position the hemming device 210 at the appropriate location adjacent to the first end 80 of the open end 15 of the comforter 10. The hemming device 210 may be driven by the drive system 140 at a predetermined speed along the guide rails 125.

The pusher device 520 may then be maneuvered into place adjacent to the open end 15 via the pusher drive 320. Once in place, the plunger 290 may act in a reciprocating motion to push the batting 20 a pre-determined distance within the edges 30, 50 of the open end 15. Although the batting 20 may tend to be somewhat elastic and bounce back towards the open end 15, the hemming device 210 moves with sufficient speed between the pusher device 520 and the fastening device 400 such that the open end 15 may be fastened before the batting 20 may interfere with the fastening process.

The tensioning device 330 may then be activated. The harpoon 340 may be extended by the tensioning drive 370 so as to pass between the edges 30, 50 of the fabric layers 40, 60. The harpoon 340 then may be rotated by about ninety degrees (90°) such that the prongs 350 catch the folds in the edges 30, 50 of the layers 40, 60. The harpoon 340 may then be retracted somewhat so as to pull on the folds in the edges 30, 50 so as to maintain the layers 40, 60 in alignment and under tension.

The edges 30, 50 of the fabric layers 40, 60 then may travel through the edge guide 380. The edge guide 380 may be positioned such that the edge guide 380 "pushes" somewhat on the edges 30, 50 while the tensioning device 330 "pulls" somewhat. The combination of the edge guide 380 and the tension device 330 thus maintains the edges 30, 50 in proper alignment and tension as the edges 30, 50 approach the fastening device 400. The fastening device 400 then may join the layers 40, 60. In the present embodiment, the sewing head 405 sews the hem 70 into the edges 30, 50 of the layers 40, 60.

Movement of the hemming device 210 may stop as the second edge 90 of the open end 15 of the comforter 10 is reached. The proximity device 411 may inform the controller 105 when the second edge 90 is approaching. As the second edge 90 approaches, the harpoon 340 again may be advanced within the open end 15 by the tensioning drive 370 so as to clear the edges 30, 50 of the fabric layers 40, 60. The harpoon 340 may then be rotated and withdrawn from the open end 15 of the comforter 10. Likewise, the pusher device 250 may be rotated out of the way via the pusher drive 320. Once the fastening device 400 reaches the second edge 90, the thread of the hem 70 may be cut via a sew head under-trimmer or other type of cutting device.

The controller 105 may then instruct the gripper assembly 500 to release the comforter 10. The jaws 610 of the clamping mechanism 600 may be released and the insertion pin 560 of the pin assembly 550 may be rotated out of the way via the pin drive 580. The comforter 10 may then be removed from the comforter closer 100. The drive system 140 may then return the hemming device 210 to its original position. The comforter 10 may then be shaken to maneuver the batting 20 into proximity to the hem 70. The comforter 10 may be shaken manually or a shaking device may be used to ensure that the batting 20 is positioned adjacent to the hem 70. Alternatively, an amount of the batting 20 may be blown into the comforter 10 just prior to the hemming device 210 completing the hem 70.

Although the comforter 10 and the gripper assembly 500 may be described as being stationary while the hemming device 210 has been described as moving about the frame 110, the opposite also may be employed. In other words, the gripper assembly 500 and the comforter 10 may be maneuvered through a stationary hemming device 210. The comforter closer 100 also may include a device to place and attach a label to the comforter 10. The various components of the comforter closer 100 may be arranged in any desired order or position.

Figure 13:
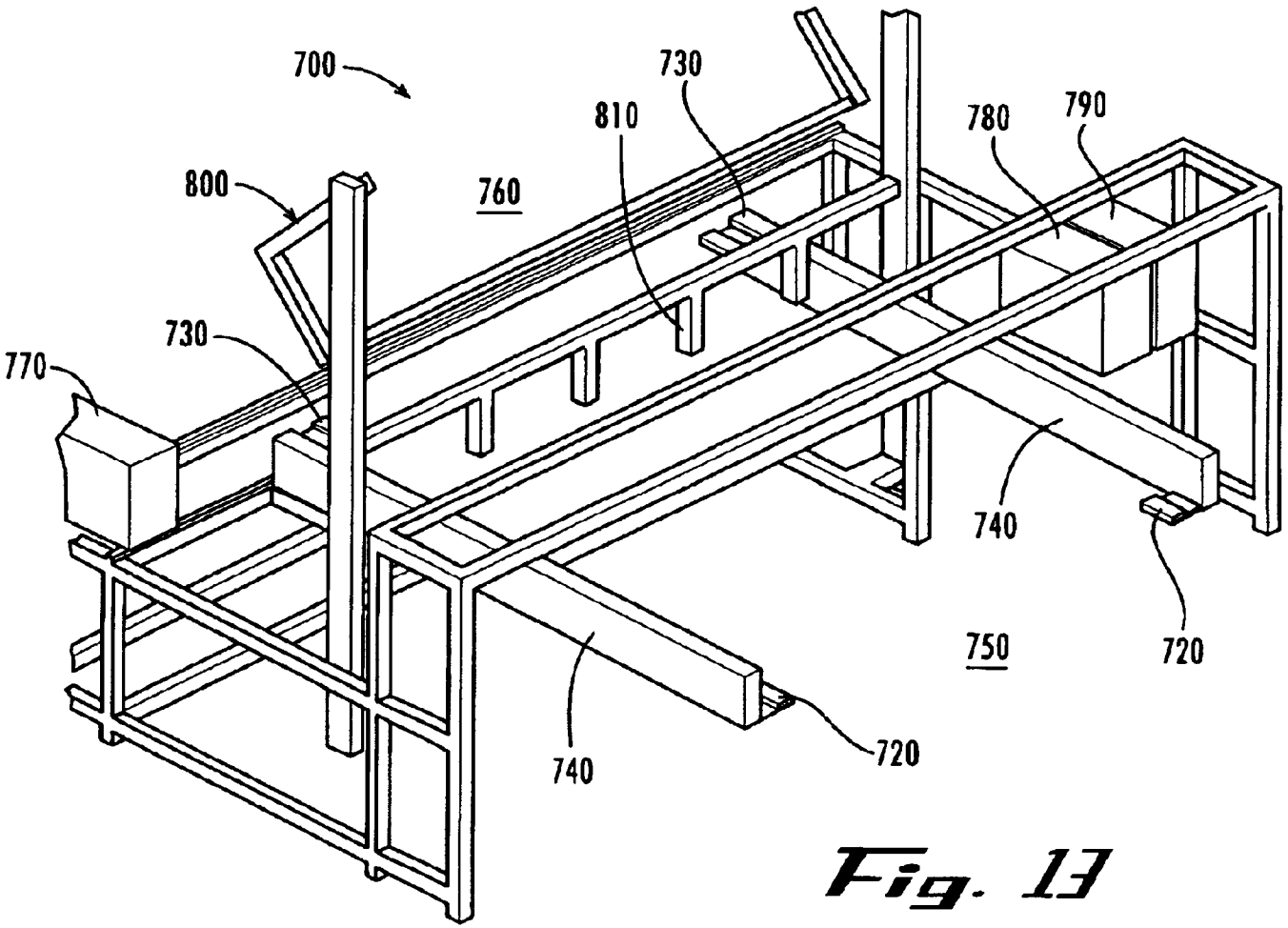
FIG. 13 is a perspective view of an alternative embodiment of the comforter closer apparatus of the present invention.

FIG. 13 shows an alternative embodiment of the present invention, a comforter closer 700. Except as described below, the comforter closer 700 may be substantially identical to the comforter closer 100 described above. In this case, the comforter closer 700 may include an extended gripper shuttle 710. The gripper shuttle 710 may be substantially identical to the frame 110 and may have any convenient size or shape.

Positioned on the gripper shuttle 710 may be two or more pairs of edge grippers, a first edge gripper pair 720 and a second edge gripper pair 730. The edge gripper pairs 720, 730 may be substantially identical to the edge grippers 520, 530 described above. The edge gripper pairs 720, 730 may be mounted for movement along an edge gripper track 740. The edge gripper track 740 may be powered so as to maneuver the edge gripper pairs 720, 730 from a loading station 750 to a hemming station 760. As such, a first comforter 10 may be attached to the first edge gripper pair 720 adjacent to the loading station 750 while a second comforter 10 may be held in place by the second edge gripper pair 730 adjacent to the hemming station 760.

The comforter closer 700 may use a hemming device 770 that may be substantially identical to the hemming device 210 described above. Likewise, the comforter closer 700 may use a cutting device 780 that may be substantially identical to the cutting device 430 described above. In this case, the cutting device 780 also may be mounted adjacent to the loading station 750. Further, the comforter closer 700 may include a pusher device 790 mounted adjacent to the cutting device 780. The pushing device 790 may be substantially identical to the pusher device 250 described above. The comforter closer 700 also may have an additional pushing device 790 that is part of the hemming device 770 in a manner similar to that described above. As is shown, the various components of the comforter closer 700 may be arranged in any desired order or position.

The comforter closer 700 may have a removal mechanism 800 so as to remove the comforter 10 from the hemming station 760. In this case, the comforter closer 700 may include one or more take away grippers 810 so as to remove the comforter 10 from the hemming station 760. Operation of the comforter closer 700 may be controlled by the controller 105 as described above.

In use, a first comforter 10 may be positioned within the first edge gripper pair 720 at the loading station 750. Once the open end 15 of the comforter 10 is tensioned by the first edge gripper pair 720, the cutting device 780 and the pushing device 790 may cut the batting 20 as described above and then push the remaining batting 20 within the open side 15. The cutting device 780 and the pushing device 790 also may be positioned adjacent to the hemming station 760. The first edge gripper pair 720 may then transport the comforter 10 along the edge gripper tracks 740 to the hemming station 760. The hemming device 770 may then close the comforter 10 in the manner described above.

While the hemming device 770 is operating, a second comforter 10 may be loaded into the second edge gripper pair 730 at the loading station 750. The cutting device 780 and the pushing device 790 may then operate as described above. The removal mechanism 800 may then remove the first comforter 10 from the loading station 750. The second edge gripper pair 730 may then transport the second comforter 10 to the hemming station 760 as described above. The process may then be repeated.

It should be apparent that the foregoing relates only to the preferred embodiments of the present invention and that numerous changes and modifications may be herein without departing from the spirit and scope of the invention as defined by the following claims and equivalence thereof.

We claim:

1. An apparatus for closing an open side of a fabric article from a first end to a second end, said apparatus comprising:

a gripping device for gripping the first end and the second end of the open side of the fabric article and tensioning the open side; and a closing device positioned adjacent to said gripping device such that said closing device maneuvers along said fabric article to fasten the open side from the first end to the second end.

2. The apparatus of claim 1, further comprising one or more guide rails associated with said closing device such that said closing device may maneuver along said one or more guide rails.

3. The apparatus of claim 2, further comprising a drive system associated with said closing device, said drive system comprising one or more drive belts so as to maneuver said closing device along said one or more guide rails.

4. The apparatus of claim 2, wherein said closing device comprises a closing device frame, said frame positioned on said one or more guide rails for movement thereon.

5. The apparatus of claim 1, wherein an amount of batting extends out of the open side of the fabric article and wherein said closing device comprises a pusher device so as to push the amount of batting within the open side of the fabric article.

6. The apparatus of claim 5, wherein said pusher device comprises a reciprocating plunger.

7. The apparatus of claim 6, wherein the fabric article includes a first layer with a folded edge and a second layer with a folded edge and wherein said pusher device comprises a pair of edge guides for maintaining the folded edge of the first layer and the folded edge of the second layer in alignment.

8. The apparatus of claim 1, wherein an excess amount of batting extends out of the open side of the fabric article and wherein said apparatus further comprising a cutting device positioned adjacent to said gripping device such that said cutting device cuts the excess amount of batting from the first end to the second end of the open side.

9. The apparatus of claim 1, wherein the fabric article includes a first layer with a folded edge and a second layer with a folded edge and wherein said closing device comprises a tensioning device.

10. The apparatus of claim 9, wherein said tension device comprises a harpoon with a plurality of extensions.

11. The apparatus of claim 10, wherein said tensioning device comprising a tensioning drive such that said tensioning drive inserts said harpoon between the first layer and the second layer, rotates said harpoon such that said plurality of extensions engages the folded edge of the first layer and the folded edge of the second layer, and retracts said harpoon by about a predetermined distance so as to tension the folded edge of the first layer and the folded edge of the second layer.

12. The apparatus of claim 1, wherein said closing device comprises an edge guide.

13. The apparatus of claim 12, wherein said edge guide comprises a plurality of U-shaped compartments.

14. The apparatus of claim 1, wherein said closing device comprises a fastening device.

15. The apparatus of claim 14, wherein said fastening device comprises a sewing head.

16. The apparatus of claim 1, further comprising a proximity device associated with said closing device so as to determine a position of said closing device along said gripping device.

17. The apparatus of claim 1, wherein said gripping device comprises a first edge gripper positioned to accommodate the first end of the fabric article and a second edge gripper positioned to accommodate the second end of the fabric article.

18. The apparatus of claim 17, wherein said gripping device comprises a gripper drive so as to maneuver said first edge gripper and/or said second edge gripper with respect to each other.

19. The apparatus of claim 17, wherein said first edge gripper and said second edge gripper comprises a pin assembly.

20. The apparatus of claim 19, wherein said pin assembly comprises an insertion pin for entry into the first end and the second end of the open side of the fabric article.

21. The apparatus of claim 20, wherein said pin assembly comprises a rotating arm driven by a pin drive.

22. The apparatus of claim 17, wherein said first edge gripper and said second edge gripper comprise a clamping mechanism for clamping the first end and the second end of the fabric article.

23. The apparatus of claim 22, wherein said clamping mechanism comprises a plurality of jaws.

24. The apparatus of claim 23, wherein said clamping mechanism comprises a clamping drive such that one or more of said plurality of jaws may rotate.

25. The apparatus of claim 1, further comprising a plurality of gripping devices.

26. The apparatus of claim 25, wherein said plurality of gripping devices comprises a first pair of gripping devices and a second pair of gripping devices.

27. The apparatus of claim 25, further comprising an edge gripper track to as to maneuver said plurality of gripping devices.

28. The apparatus of claim 27, further comprising a loading station and a fastening station, such that said plurality of gripping devices maneuver along said edge gripper track between said loading station and said fastening station.

29. The apparatus of claim 28, further comprising a removal mechanism positioned about said fastening station.

30. An apparatus for closing a fabric article, said fabric article having a first layer with a folded edge and a second layer with a folded edge, said apparatus comprising:

a tensioning device positioned along a predetermined path;

said tension device comprising a harpoon;

said harpoon comprising a plurality of prongs;

said tensioning device comprising a tensioning drive such that said tensioning drive inserts said harpoon between the first layer and the second layer, rotates said harpoon such that said plurality of prongs engages the folded edge of the first layer and the folded edge of the second layer, and retracts said harpoon by about a predetermined distance so as to tension the folded edge of the first layer and the folded edge of the second layer; and a fastening device positioned along said predetermined path such that said fastening device fastens the folded edge of the first layer with the folded edge of the second layer.

31. The apparatus of claim 30, further comprising an edge guide positioned along said predetermined path between said tensioning device and said fastening device.

32. The apparatus of claim 31, wherein said edge guide comprises a plurality of U-shaped compartments.

33. The apparatus of claim 30, wherein said fastening device comprises a sewing head so as to stitch the folded edge of the first layer with the folded edge of the second layer.

34. A method for closing an open side of a fabric article, with the fabric article having a first layer and a second layer, said method comprising the steps of:

folding the first layer to form a first folded edge;

folding the second layer to form a second folded edge;

aligning the first folded edge and the second folded edge;

passing a tensioning guide along the open side to keep the first folded edge and the second folded edge in alignment; and passing a fastening device along the open side to close the open side along the first folded edge and the second folded edge.

35. The method of claim 34, wherein the fabric article includes an amount of batting therein, said method further comprising the step of adding additional batting prior to said step of passing said fastening device along the open side.

36. The method of claim 34, wherein the fabric article includes an amount of batting therein, said method further comprising the step of shaking said fabric article to position the batting therein.

* * * * *